US011820556B2

(12) United States Patent
Klaassen et al.

(10) Patent No.: US 11,820,556 B2
(45) Date of Patent: Nov. 21, 2023

(54) TRANSPORT POUCH, METHOD FOR TRANSPORTING AN ITEM, AND METHOD FOR MANUFACTURING THE TRANSPORT POUCH

(71) Applicant: DAKLAPACK EUROPE B.V., Lelystad (NL)

(72) Inventors: Dave Willem Klaassen, Ermelo (NL); Jelle Bart Jeths, Lelystad (NL)

(73) Assignee: DAKLAPACK EUROPE B.V., Lelystad (NL)

( * ) Notice: Subject to any disclaimer, the term of this patent is extended or adjusted under 35 U.S.C. 154(b) by 460 days.

(21) Appl. No.: 17/264,548

(22) PCT Filed: Jul. 24, 2019

(86) PCT No.: PCT/NL2019/050477
§ 371 (c)(1),
(2) Date: Jan. 29, 2021

(87) PCT Pub. No.: WO2020/027653
PCT Pub. Date: Feb. 6, 2020

(65) Prior Publication Data

US 2021/0309419 A1 Oct. 7, 2021

(30) Foreign Application Priority Data

Aug. 1, 2018 (NL) ..... 2021415

(51) Int. Cl.
*B65D 33/18* (2006.01)
*B65B 5/02* (2006.01)
(Continued)

(52) U.S. Cl.
CPC ..... *B65D 33/18* (2013.01); *B65B 5/022* (2013.01); *B65B 5/045* (2013.01); *B65B 7/06* (2013.01);
(Continued)

(58) Field of Classification Search
CPC ..... B65B 5/022; B65B 5/045; B65B 7/06; B65D 33/18; B65D 33/20; B65D 33/2508; B65D 75/30; B65D 75/58; B65D 79/005
(Continued)

(56) References Cited

U.S. PATENT DOCUMENTS 3,735,918 A * 5/1973 Tundermann ..... B65D 33/18 383/85
4,509,196 A * 4/1985 Sak et al. ..... B65D 33/20 383/89
(Continued)

FOREIGN PATENT DOCUMENTS

FR 2 725 957 A1 4/1996
FR 2 841 221 A1 12/2003
(Continued)

OTHER PUBLICATIONS

International Search Report issued in PCT/NL2019/050477 (PCT/ISA/210), dated Sep. 20, 2019.
(Continued)

*Primary Examiner* — Stephen F. Gerrity
(74) *Attorney, Agent, or Firm* — Birch, Stewart, Kolasch & Birch, LLP

(57) ABSTRACT

A transport pouch includes a flap portion and a body portion separated from each other by a folding portion. The transport pouch also includes a front panel and a rear panel, an adhesive closure, at least one removable cover, and a form closure. When the flap portion of the transport pouch is folded onto the body portion of the transport pouch, the flap area of the adhesive closure is adhered to the body area of the adhesive closure, and the form closure is closed, the folding portion of the transport pouch acts as a barrier that prevents billowing of the body portion of the transport pouch, caused by a relative pressure increase in the transport
(Continued)

space due to a pressure drop in the surroundings of the transport pouch, from tearing open the form closure and thus from tearing open the adhesive closure.

13 Claims, 3 Drawing Sheets

(51) Int. Cl.

| | |
|---|---|
| ***B65B 5/04*** | (2006.01) |
| ***B65B 7/06*** | (2006.01) |
| ***B65D 33/25*** | (2006.01) |
| ***B65D 79/00*** | (2006.01) |
| ***B65D 33/20*** | (2006.01) |
| ***B65D 75/30*** | (2006.01) |
| ***B65D 75/58*** | (2006.01) |

(52) U.S. Cl.
CPC ..... *B65D 33/20* (2013.01); *B65D 33/2508* (2013.01); *B65D 75/30* (2013.01); *B65D 75/58* (2013.01); *B65D 79/005* (2013.01)

(58) Field of Classification Search
USPC ..... 53/469; 383/61.2, 63, 66, 78, 83, 84, 85, 383/88, 89, 93, 205, 210.1, 211
See application file for complete search history.

(56) References Cited

U.S. PATENT DOCUMENTS

| | | | | |
|---|---|---|---|---|
| 6,196,716 | B1 * | 3/2001 | Geyer | B65D 33/34 383/84 |
| 2003/0228077 | A1 * | 12/2003 | Laske | B65D 33/20 383/88 |
| 2005/0036716 | A1 * | 2/2005 | Geyer | B65D 33/18 383/84 |
| 2011/0103714 | A1 | 5/2011 | Steele et al. | |
| 2014/0270581 | A1 * | 9/2014 | Jons | B65B 7/06 383/210 |
| 2016/0031608 | A1 * | 2/2016 | Olechowski et al. | B65D 33/18 383/210.1 |
| 2016/0221722 | A1 * | 8/2016 | Burke et al. | B65B 5/045 |

FOREIGN PATENT DOCUMENTS

| | | | |
|---|---|---|---|
| FR | 2 973 351 | A1 | 10/2012 |
| WO | WO-9115406 | A1 * | 10/1991 |

OTHER PUBLICATIONS

Written Opinion of the International Searching Authority issued in PCT/NL2019/050477 (PCT/ISA/237), dated Sep. 20, 2019.

* cited by examiner

TRANSPORT POUCH, METHOD FOR TRANSPORTING AN ITEM, AND METHOD FOR MANUFACTURING THE TRANSPORT POUCH

The invention relates to a transport pouch, in particular to a transport pouch suitable for air transport, e.g. transport by airplane. The invention furthermore provides a method for transporting an item using a transport pouch and a method for manufacturing a transport pouch.

FIELD AND BACKGROUND OF THE INVENTION

It is known to transport products in pouches, and to use these transport pouches for air transport, i.e. transport by airplane. Typically, a transport pouch comprises a sealable entry opening, the entry opening providing access to a transport space for holding an item inside the pouch.

With air transport the closures or sealing of the pouch is a critical aspect. During the air transport, the air pressure in the surroundings of the transport pouch may lower. Lowering of the surrounding pressure causes air received in the sealed pouch to expand, and thus causes an expansion, or billowing, of the pouch. Furthermore, the limited space inside the pouch may cause a relative pressure increase, i.e. the pressure inside the pouch may increase relative to the pressure outside the pouch.

The billowing of the pouch, in particular in combination with an increased inside pressure relative to the surrounding pressure, acts as a load on the closure of the pouch, and may tear open the closure. This is unwanted because in most cases a leak free transport is preferred. Also, the transported item, or part thereof, may exit the pouch through the opened, or partially opened, closure.

Especially with low cost disposable transport pouches any improvement on use and/or simplification in production is an advantage.

It is an object of the invention to obviate the problems described hereinabove at least to a certain extent. It is a further object of the invention to provide an alternative transport pouch, preferably an improved transport pouch. It is a further aspect of the invention to provide a disposable transport pouch that is easy to use and/or can be obtained at low cost.

SUMMARY OF THE INVENTION

This object is achieved by providing a transport pouch according to the invention.

A transport pouch according to the claimed invention has a flap portion and a body portion separated from each other by a folding portion, the transport pouch comprises:

a plastic front panel and a plastic rear panel, wherein the front panel and rear panel are connected to each other along a top side, a bottom side, a left side and a right side, and wherein the front panel and rear panel define between them an interior space, wherein the flap portion of the transport pouch comprises a flap section of the front panel and a flap section of the rear panel, and the body portion of the transport pouch comprises a body section of the front panel and a body section of the rear panel, wherein the flap section of the front panel and the flap section of the rear panel are separated from the respective body section of the front panel and body section of the rear panel by a folding section, along which folding section the flap portion of the transport pouch is foldable onto the body portion of the transport pouch, wherein the folding portion of the transport pouch divides the interior space into a transport space for holding an item, which transport space is provided in the body portion of the transport pouch, and an entry space, located in the flap portion of the transport pouch, and wherein the flap section of the front panel is provided with an entry opening for inserting an item, via the entry space, into the transport space of the transport pouch, an adhesive closure, wherein the adhesive closure comprises a flap area on the flap section of the front panel and a body area on the body section of the front panel, wherein the entry opening is located in the flap area of the adhesive closure, and wherein the flap area and/or the body area of the adhesive closure are/is provided with an adhesive to enable the flap area to be adhered to the body area such that the entry opening is sealed along its entire periphery, to seal the transport pouch during transport, at least one removable cover, wherein the at least one removable cover is provided on the flap area and/or the body area of the adhesive closure, to shield the adhesive prior to the flap area being adhered onto the body area, and wherein the at least one removable cover, when provided on the flap area of the adhesive closure, is provided with an opening that enables access to the entry opening in the flap section of the front panel;

a form closure, e.g. a zip lock or minigrip, wherein the form closure is provided in the flap portion of the transport pouch, wherein the form closure comprises a first part and a second part, wherein the first part is disposed on an inside surface of the flap section of the front panel, between the entry opening and the folding section of the front panel, and extends between the left side and the right side of the front panel, wherein the second part is disposed on an inside surface of the flap section of the rear panel and extends between the left side and the right side of the rear panel, and which first part and second part of the form closure are configured to releasable mate such that the form closure, when closed, blocks passage from at least a part of the entry space to the transport space, such that, when the flap portion of the transport pouch is folded onto the body portion of the transport pouch, the flap area of the adhesive closure is adhered to the body area of the adhesive closure, and the form closure is closed, the folding portion of the transport pouch acts as a barrier that prevents billowing of the body portion of the transport pouch, caused by a relative pressure increase in the transport space due to a pressure drop in the surroundings of the transport pouch, from releasing the first part of the form closure from the second part of the form closure and thus from tearing open the form closure.

With a transport pouch according to the claimed invention, the item is inserted into the transport space. The inserted item pushes the body section of the front panel and the rear panel away from each other. The entry space is free of items. Thus, once the item has been inserted into the transport space, the flap sections of the panels are adjacent each other, and the flap portion of the transport pouch is substantially flat.

Providing the form closure in the flap portion and between the entry opening and the transport space, prevents the item to move into the entry space. Thus, once an item has been inserted into the storage space and the form closure is closed, the item can no longer move into the entry space. The empty entry space ensures that the flap portion is relatively flat when it is folded onto the body portion to seal the entry opening.

In an embodiment, the form closure is configured to, in a closed configuration, provide a gas tight seal between the transport space and the entry space. The closed form closure thus prevents fluid form travelling form the transport space to the entry space, and thus, in addition to the fold, prevents the billowing of the body portion of the transport pouch to cause a significant pressure increase on the sealed entry opening.

According to the claimed invention, the transport pouch is a foldable transport pouch, provided with an entry opening in the front panel, with a form closure and with a folding portion. The form closure is provided in the flap portion of the transport pouch, between the transport space and the entry opening. The folding section is provided between the transport space and the form closure. Thus, with a transport pouch according to the claimed invention, to seal the entry opening the flap section with the form closure is folded on top of the body section. It has been found that in this configuration the fold portion prevents the billowing, i.e. the front sheet moving away from the rear sheet, to substantially extend beyond the folding portion.

The fold keeps the front panel close to the rear panel at their respective folding sections, preventing the billowing to pass beyond the folding portion of the transport pouch. Furthermore, because the flap portion of the transport pouch is folded onto the body portion of the transport pouch, the billowing of the body portion pushes the front panel with the first part of the form closure towards the rear panel with the second part of the form closure, and thus acts against the form closure being torn open. Thus, the transport configuration reduces the pressure on the form closure, and ultimo the pressure on the entry opening. Therefore, the transport pouch according to the claimed invention is able to withstand a significant relative pressure increase in the transport space, i.e. an increase in pressure relative to the surrounding pressure, without the adhesive sealing of the transport pouch being torn open.

The invention thus provides an alternative transport pouch, more in particular the invention allows for an improved transport pouch that is able to withstand a significant drop in surrounding pressure without the billowing of the pouch causing the closure of the pouch to be torn open, and thus form the sealed entry opening to be torn open.

The invention allows for a transport pouch withstanding a 95 kPa pressure difference between the transport space of the transport pouch and the surroundings of the transport pouch without leakage or the sealed entry opening from tearing open.

Furthermore, the transport pouch according to the claimed invention allows for providing a disposable transport pouch that is easy to use and/or can be obtained at low cost.

In an embodiment, in a direction perpendicular to the folding portion, the flap portion has a size that is smaller than the size of the body portion, such that when the flap portion is folded onto the body portion, the flap portion only partially overlaps the bottom portion. This allows for a user to hold the body portion while folding the flap portion onto the boy portion, and thus facilitates correctly and secure attaching the flap portion to the body portion of the transport pouch.

In an embodiment, the flap area of the adhesive closure extends from the left side of the transport pouch to the right side of the transport pouch. Thus, the flap portion and the body portion are adhered to each other over the full width of the transport pouch, and thus along the entire fold when the flap portion is adhered to the body portion. This ensures that the fold is optimally kept in position during a billowing of the body portion of the transport pouch. In an alternative embodiment, the adhesive may be provided up to a distance from the actual sides of the transport pouch, for example may not cover sealing zones that extend along the edges of the front panel. Also, the adhesive may cover the whole area of the adhesive closure, or for example be distributed in parallel lines or a checkerboard pattern in combination with an adhesive line extending around the entry opening, etc.

In an embodiment, when the flap portion is adhered to the body portion, the adhesive covers at least 60% of the flap portion and preferably extends over substantially the entire width of the flap portion. Thus, the flap portion is adhered over a large area thereof to the body portion, which keeps the flap portion closely adjacent the body portion prior to and during a billowing of the body portion. This further prevents a billowing of the body portion from pulling away part of the flap portion from the body portion and is thus beneficial for keeping the fold in position and thus for an optimal barrier effect of the fold.

In a further embodiment, the front panel and rear panel are at least along their left side and/or their right side sealed to each other along sealing zones, the sealing zones each forming a strip that extends along the left side and/or the right side of the transport pouch, and preferably below the body area of the adhesive closure in at least one strip is provided a recess, e.g. a V-shaped cut out, in its peripheral edge to initiate a tear, to enable a person to open the transport pouch by tearing open the body portion of the transport pouch.

In an alternative embodiment, the sealings are narrow, providing line like seals. Furthermore, when the transport pouch is manufactured from a folded sheet or from a tubular sheet, the front panel and the rear panel of the transport pouch may along respectively one or two sides be connected by folds, i.e. be integrally connected panels.

The strips, for example comprising an area having a width of at least 0.5 cm, e.g. 1.5 cm, provide for a wide sealing zone, i.e. a relatively large sealing area, and thus for a strong bond between the front panel and the rear panel. A strong bond between the front panel and the rear panel allows for a high over pressure, i.e. a high pressure in the transport space compared to the pressure in the surroundings of the transport bag, in the transport space without the front panel tearing away from the rear panel.

In an embodiment, the transport pouch can be opened after transport by tearing open the body portion of the pouch. Providing the strip with a recess, for example a V-shaped cut out furthermore enables tearing open the body portion of the pouch in spite of the wide sealing area's and the strong bond between the front panel and the rear panel of the transport pouch. In an embodiment, the body portion is on opposite sides, i.e. the left side and the right side, provided with a recess, to enable tearing open the body portion from each side.

In an embodiment, the flap is, at the side opposite the folding section, provided with a pull tab for tearing the flap portion from the body portion after transport.

It is noted that due to the folding portion forming a barrier during transport, a relative pressure increase in the transport space will not act fully, or even not at all, on the adhesive closure. Because the adhesive closure does not need to be able to withstand the full load of the relative pressure increase, the adhesive strength can be reduced. Thus, the invention allows for a transport pouch comprising a low strength adhesive closure for sealing the entry opening, i.e. an adhesive closure that after transport can be opened by pulling the flap portion from the body portion.

In the prior art an adhesive closure sealing the insert opening is required to withstand the relative pressure increase in the space adjacent the insert opening. Thus, with a transport pouch able to withstand a significant relative pressure increase, the adhesive strength required to prevent the entry opening from being torn open would be such that a person would not be able to pull the flap from the body portion after transport. Opening the pouch would thus be more complicated and for example may require a scissors to cut open the transport bag, which would risk damaging the item in the transport chamber of the pouch.

It is submitted that, when an item is held in the transport space, the item typically spaces the body section of the front panel away from the body section of the rear panel. thus, besides the item, air will be comprised in the transport space as well. The configuration of the transport pouch is such that when it is closed the flap portion will be flattened and only a minimum of air will be comprised in the entry space. Thus, in case of a pressure drop in the surroundings of the transport pouch, the billowing of the flap portion will be minimal.

In an embodiment, the flap area of the adhesive closure and the body area of the adhesive closure are arranged closely next to each other, for example are separated by an folding section such that the distance between the flap area and the body area is less than 3 cm, preferably less than 2 cm, for example is 1 cm. It is noted that in the latter embodiment, when the transport pouch is in the closed configuration, the distance between the adhesive and the apex of the folding portion is about 0.5 cm respectively. Positioning the flap area close to the body area propagates a sharp fold, i.e. a fold with a small radius, in the transport pouch when the flap area is adhered to the body area, which is beneficial to the barrier properties of the fold.

In an embodiment, the form closure is located at a distance from the folding portion of the transport pouch, preferably is located at a distance from the folding section of the rear panel, such that when the flap section is folded onto the body section and the flap area is adhered to the body area, the form closure is located at least 1 cm, preferably is located at least 1.5 cm, away from an apex of the folded rear panel, i.e. the part of the folding section of the rear panel that extends substantially perpendicular to the flap section and the body section of the rear panel. Preferably, the flap area of the adhesive closure overlaps with the form closure, i.e. the form closure is provided within the flap area, beit on the opposite side of the front panel.

Providing distance between the form closure and the folding portion of the transport pouch, preferably the folding section of the rear panel, allows for the form closure to be located in a part of the flap portion that is adjacent the body portion of the transport pouch when the adhesive closure is closed and the flap portion is folded onto and adhered to the body portion. This in turn ensures that, in case of billowing of the body portion, the boy section of the front panel pushes against the flap section of the front panel, and thus urges the part of the form closure that is mounted on the inside surface of the front panel towards the part of the form closure mounted on the inside surface of the rear panel, and thus obstructs the tearing open of the form closure by the billowing.

In an embodiment, the form closure is located at a distance from the folding portion, preferably is located at a distance from the folding section of the rear panel, such that when the flap section is folded onto the body section and the flap area is adhered to the body area, the form closure is located at most 3 cm, preferably is located at least 2 cm, away from an apex of the folded rear panel, i.e. the part of the folding section of the rear panel that extends substantially perpendicular to the flap section and the body section of the rear panel. Thus, when the form closure is closed, a maximum of the inner space of the flap portion is sealed off of from the inner space of the body portion, and fluids in the body portion are prevented from flowing into the flap portion. This is beneficial for the flap portion remain flat during transport and in particular during a billowing of the body portion.

In an embodiment, the flap area or the body area of the adhesive closure is provided with an adhesive, and respectively the body section or the flap section of the front panel is provided with markings that indicate where the flap section of the transport pouch should be folded onto the body section of the transport pouch such that the flap area and the body area of the adhesive closure to seal the inlet opening along the entire circumference. Such an embodiment allows for providing adhesive on a single area of the adhesive closure, which facilitates the production process and closing the adhesive closure prior to transport, but promotes an optimal positioning of the flap portion relative to the body portion of the transport pouch.

In an embodiment, the front panel and the rear panel are made from a flexible sheet material, for example a flexible plastic film, preferably a transparent sheet material, and wherein the plastic sheet material preferably comprises multiple layers of different types of plastic materials.

For example, the rear panel and/or the front panel are a laminate of multiple layers of plastic material sealed together, the material properties of the different layers being chosen for providing a panel with for example optimal mechanical properties and optimal barrier properties, e.g. for blocking certain fluids from passing through the panel.

In an embodiment, the front panel and rear panel are each rectangular panels, and the entry opening is a slit in the front panel, which slit extends parallel to the top side and the bottom side of the front panel. Such a configuration is in particular beneficial when the transport pouch is to be opened after transport by tearing open the adhesive closure, because it allows for an optimal sealing of the entry opening, but also allows for easy pealing open starting at a corner of the rectangular sealing area.

The invention furthermore provides a method for transporting an item with a transport pouch according to one or more of the preceding claims, the method comprising:

- via the entry opening and the entry space inserting an item into the transport space of the transport pouch;
- closing the form closure;
- removing the at least one removable cover; and
- folding the transport pouch along the folding portion such that the flap area of the adhesive closure is adhered to the body area of the adhesive closure to seal the entry opening.

A further method according to the invention comprises:

- transporting the transport pouch with the item; and
- opening the transport pouch, preferably by tearing open the body portion of the transport pouch.

The invention furthermore provides a method for manufacturing a transport pouch according to the invention, the method comprising:

applying adhesive to the flap area and/or the body area of the adhesive closure on the front panel;

providing an entry opening in the flap area of the front panel;

between rear panel and front panel providing a form closure and fixing the form closure to the flap area of the front panel and the flap area of rear panel, and fixing the front panel to the rear panel such that the front panel and the rear panel are connected to each other along the top side, the bottom side, the left side and the right side, and the front panel and rear panel define between them an interior space.

It is submitted that in the context of this invention, an item can be any type of object, e.g. a solid product, a liquid product, a gaseous product, or a mixture thereof, a single object, multiple objects, a granulate, etc. that fits through the entry opening and in the transport space.

In an embodiment, the transport pouch is dimensioned such that it can be passed through a letter box, and/or such that it can be received in an envelop that can be passed through a letter box. In yet another embodiment, the transport pouch is transported in a box, which box is dimensioned to allow the transport pouch to billow inside the closed box.

Advantageous embodiments of the transport pouch according to the claimed invention and the method according to the claimed invention are disclosed in the sub claims and in the description, in which the invention is further illustrated and elucidated on the basis of a number of exemplary embodiments, of which some are shown in the schematic drawing. In the figures, components corresponding in terms or construction and/or function are provided with the same last two digits of the reference numbers.

BRIEF DESCRIPTION OF THE DRAWINGS

In the drawings;

FIG. 4 shows a frontal view of the transport pouch of FIG. 3, with the flap portion in see through.

FIGS. 1-5 depict a transport pouch 1 according to the invention. The transport pouch 1 according to the claimed invention has a flap portion 2 and a body portion 3 separated from each other by a folding portion 4.

Figure 2:
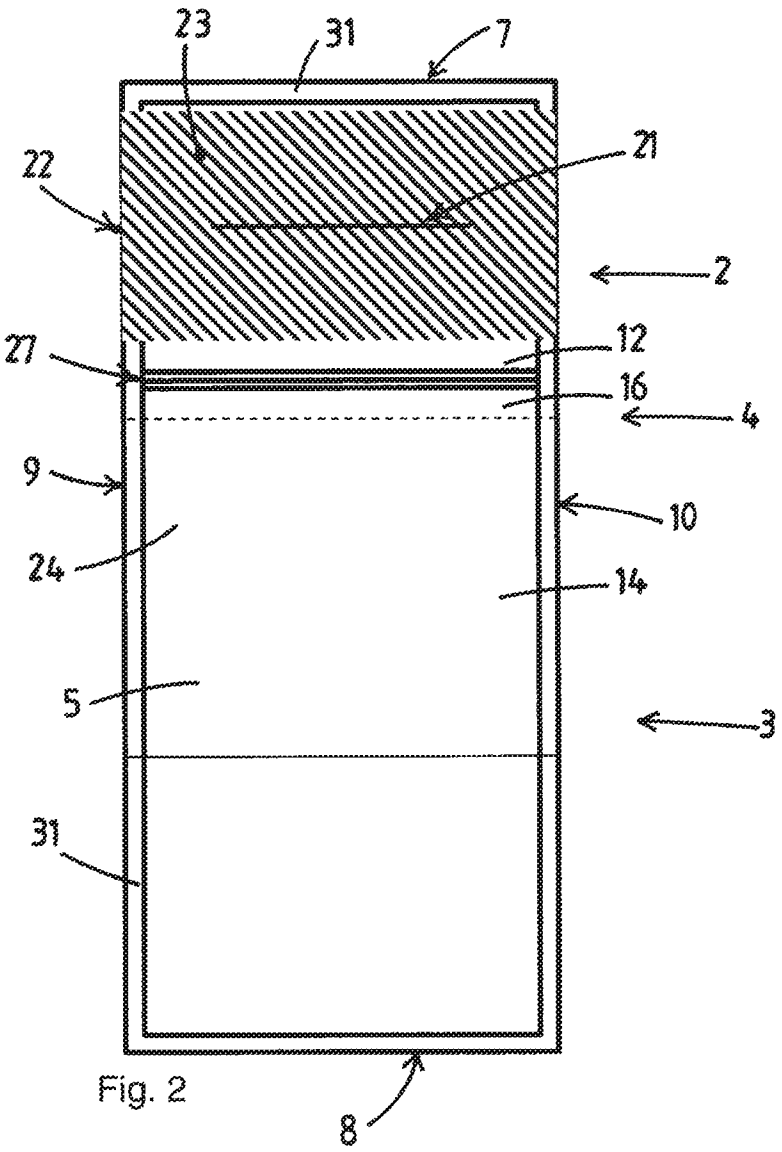
FIG. 2 shows a frontal view of a transport pouch of FIG. 1, with the removable cover removed.

The transport pouch 1 comprises a plastic front panel 5 and a plastic rear panel 6. In the embodiment shown, the front panel 5 and the rear panel 6 are rectangular panels of similar size. Such a configuration is in particular suitable for manufacturing the transport pouch from long strips of plastic sheet material. It is submitted that in an alternative embodiment, the panel may be provided with rounded corners and/or an alternative contour.

The front panel 5 and rear panel are 6 connected to each other along a top side 7, a bottom side 8, a left side 9 and a right side 10. The front panel 5 and rear panel 6 define between them an interior space 11, which is depicted in a cross sectional side view shown in FIG. 5.

The flap portion 2 of the transport pouch 1 comprises a flap section 12 of the front panel 5 and a flap section 13 of the rear panel 6. The body portion 3 of the transport pouch 1 comprises a body section 14 of the front panel 5 a body section 15 of the rear panel 6.

The flap section 12 of the front panel 5 and the flap section 13 of the rear pane 16 are separated from the respective body section 14 of the front panel 5 and body section 15 of the rear panel 6 by a folding section 16, 17. The folding section 16 of the front panel 5 and the folding section 17 of the rear panel 6 thus are comprised by the folding portion 4 of the transport pouch. Along these folding sections 16, 17 the flap portion 2 of the transport pouch 1 is foldable onto the body portion 3 of the transport pouch.

Figure 1:
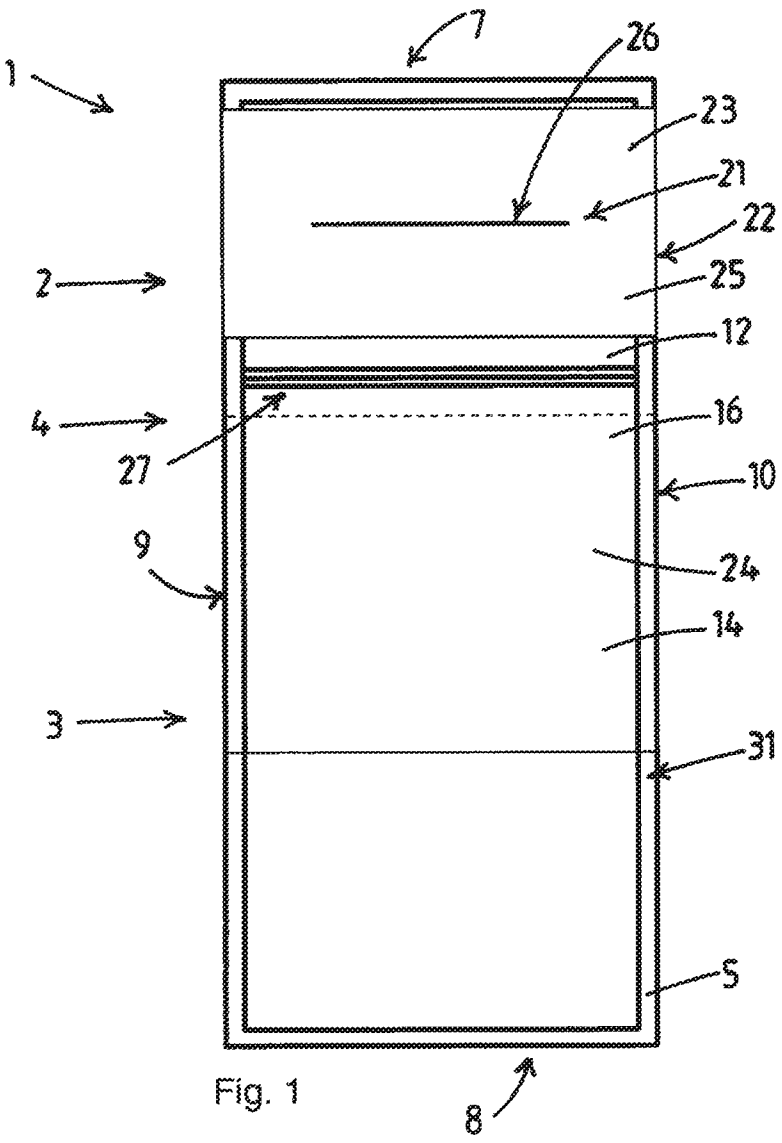
FIG. 1 shows a frontal view of a transport pouch according to the claimed invention, depicted in an open configuration and with a removable cover on a flap portion of the transport pouch.

In the embodiment shown, the front panel 5 of the transport pouch is made of a transparent sheet material, therefore a form closure 27 that is located on the inside of the transport pouch 1 is visible in FIGS. 1 and 2.

Figure 4:
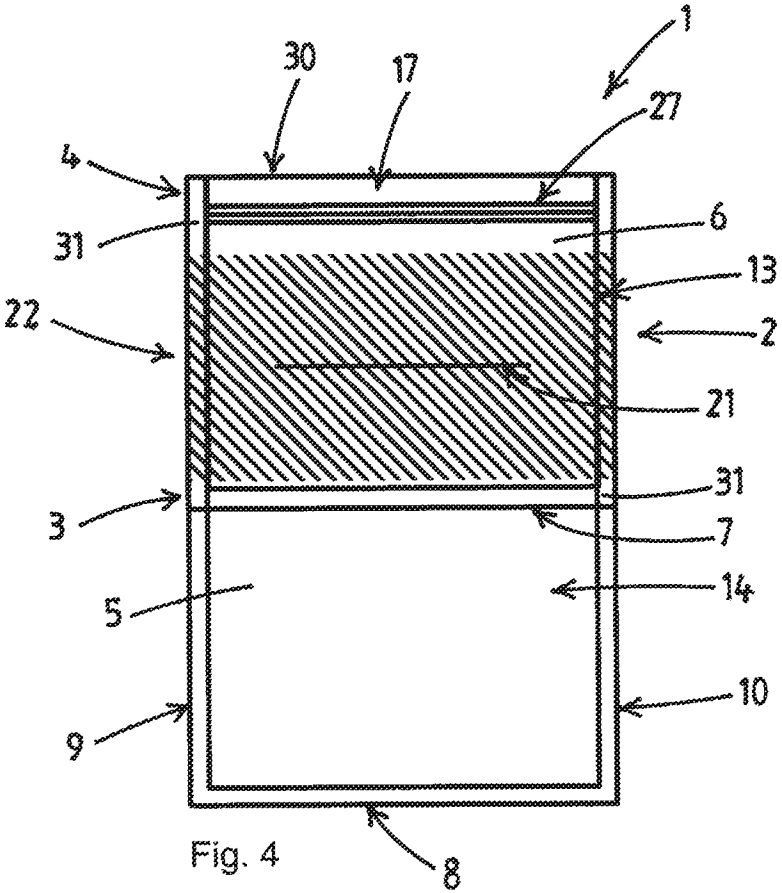
Figure 3:
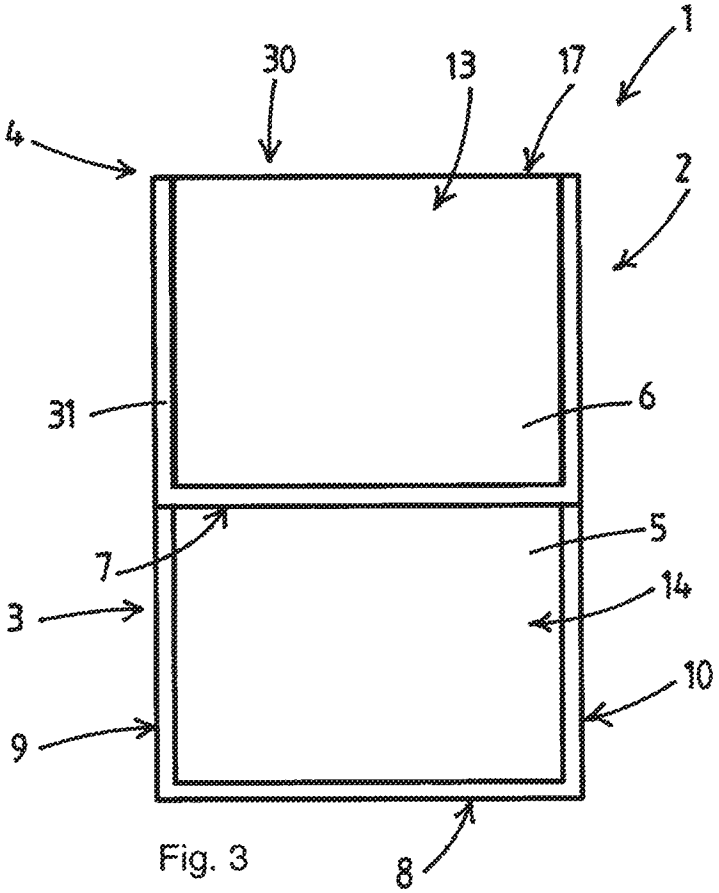
FIG. 3 shows a frontal view of the transport pouch of FIG. 1, depicted in a closed configuration.
Figure 5:
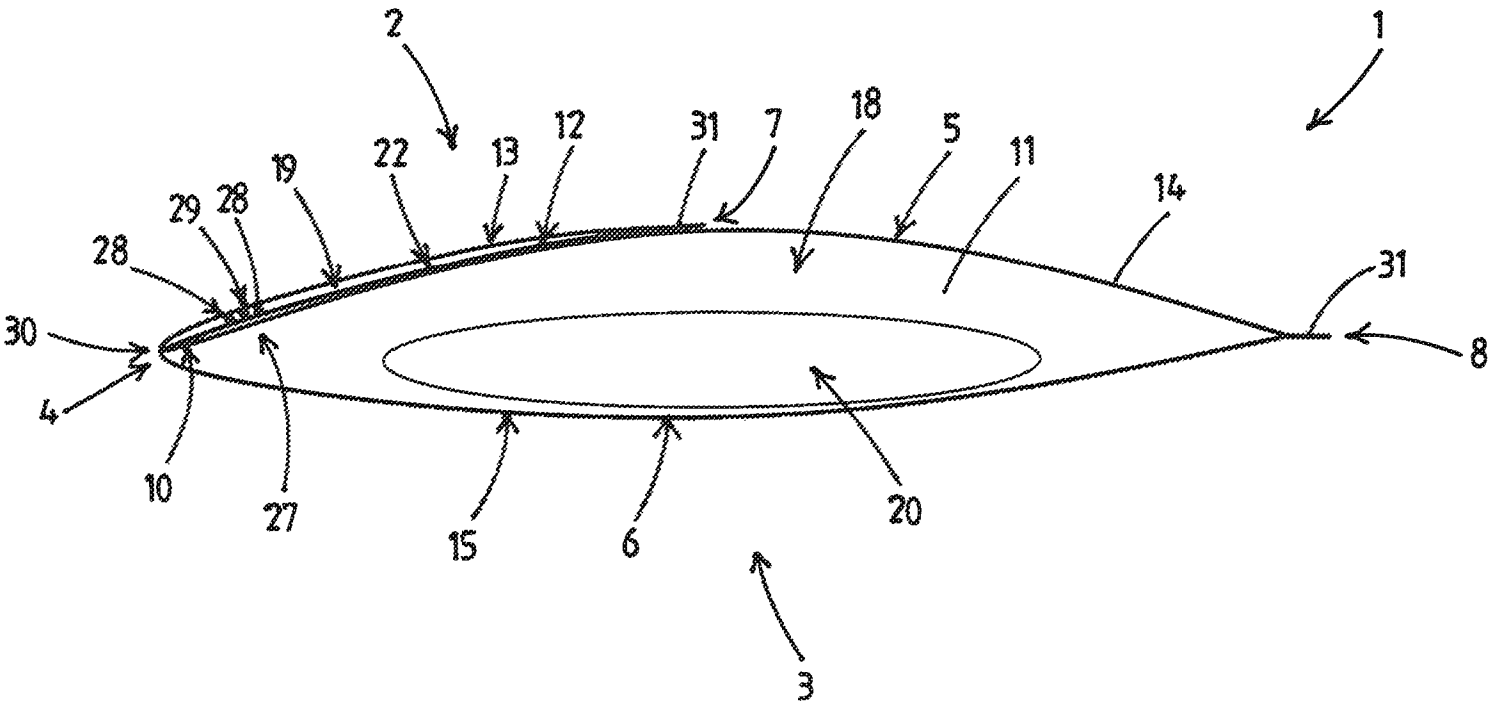
FIG. 5 shows a cross sectional side view of the transport pouch of FIG. 1, depicted in a closed configuration and holding an item.

The transport pouch 1 is shown in the folded configuration, i.e. with the flap portion 2 folded onto the body portion 3, in FIG. 3, FIG. 4, and FIG. 5. It is noted that FIG. 4 is in partial see through, and therefore, in contrast with FIG. 3, shows the form closure 27, the adhesive 22, and the entry opening 21.

The folding portion 4 of the transport pouch 1 divides the interior space 11 into a transport space 18 for holding an item 20, which transport space is provided in the body portion 3 of the transport pouch 1, and an entry space 19, located in the flap portion 2 of the transport pouch 1.

The flap section 12 of the front panel 5 is provided with an entry opening 21 for inserting the item 20, via the entry space 19, into the transport space 18 of the transport pouch 1.

The transport pouch further comprises an adhesive closure 22. The adhesive closure 22 comprises a flap area 23 on the flap section 12 of the front panel 5, and a body area 24 on the body section 14 of the front panel 5. The entry opening 21 is located in the flap area 23 of the adhesive closure 22.

With a transport pouch according to the invention, the flap area and/or the body area of the adhesive closure are/is provided with an adhesive to enable the flap area to be adhered to the body area such that the entry opening is sealed along its entire periphery, to seal the transport pouch during transport.

In the embodiment shown, the flap area 23 of the adhesive closure 22 is provided with an adhesive to enable the flap area to be adhered to the body area 24 such that the entry opening 21 is sealed along its entire periphery, to thus seal the transport pouch during transport.

Furthermore, the transport pouch 1 is provided with at least one removable cover 25. The removable cover 25 is provided on the area of the adhesive closure 22 provided with an adhesive, in the embodiment shown the flap area 23 of the adhesive closure 22, to shield the adhesive prior to the flap area 23 being adhered to the body area 24.

FIG. 1 shows the transport pouch 1 with the removable cover 25 on the flap area 23 of the adhesive closure 22. FIG. 2 the transport pouch 1 with the removable cover 25 removed.

In the embodiment shown, the at least one removable cover 25 is provided with an opening 26 that enables access to the entry opening 21 in the flap section 12 of the front panel 5.

The transport pouch is furthermore provided with a form closure 27, for example a form closure of the zip lock or minigrip type, which form closure 27 is provided in the flap portion 2 of the transport pouch 1.

The form closure 27 comprises a first part 28 and a second part 29. The first part 28 is disposed on an inside surface of the flap section 12 of the front panel 5, between the entry opening 21 and the folding section 16 of the front panel 5, and extends between the left side 9 and the right side 10 of the front panel 5.

The second part 29 is disposed on an inside surface of the flap section 13 of the rear panel 6 and extends between the left side 9 and the right side 10 of the rear panel 6.

The first part 28 and second part 29 of the form closure 27 are configured to releasable mate such that the form closure 27, when closed, blocks passage from at least a part of the entry space 19 to the transport space 18. Preferably, the form closure when closed blocks the full passage, preventing any fluid from passing from the transport space 18 into the entry space. Thus, the form closure prevents a pressure increase in the transport space from fully expanding into the entry space, and thus keeps the billowing of the flap portion and the pressure on the adhesive closure to a minimum.

Thus, when the flap portion 2 of the transport pouch 1 is folded onto the body portion 3 of the transport pouch 1, the flap area 23 of the adhesive closure 22 is adhered to the body area 24 of the adhesive closure 22, and when the form closure 27 is closed, the folding portion 4 of the transport pouch 1 acts as a barrier that prevents billowing of the body portion 3 of the transport pouch 1, caused by a relative pressure increase in the transport space 18 due to a pressure drop in the surroundings of the transport pouch 1, from releasing the first part 28 of the form closure 27 from the second part 29 of the form closure 27 and thus from tearing open the form closure 27.

FIG. 5 shows a cross sectional side view of the transport pouch 1, with the body portion of the pouch in an expanded state due to a reduced pressure in the surroundings of the transport pouch. The billowing of the body portion 3 pushes the body section 14 of the front panel 5, or at least a part thereof, against the flap section 12 of the front panel 5 front panel. Furthermore, the section, more in particular the fold, along which the flap portion 2 is folded onto the body portion 3 form a barrier between the transport space 18 and the entry space 19.

With a transport pouch according to the claimed invention, the item is inserted into the transport space, moving the body section of the front panel and the rear panel away from each other. The entry space is free of items. Thus, once the item has been inserted into the transport space, the flap sections of the panels are adjacent each other.

When an item is held in the transport space, the item typically spaces the body section of the front panel away from the body section of the rear panel. thus, besides the item, air will be comprised in the transport space as well. The configuration of the transport pouch is such that when it is closed the flap portion will be flattened and only a minimum of air will be comprised in the entry space. Thus, in case of a pressure drop in the surroundings of the transport pouch, the billowing of the flap portion will be little.

Providing the form closure between the entry opening and the transport space, prevents the item to move from the transport space into the entry space when the transport pouch is not yet folded. Thus the entry space is free from items. The empty entry space ensures that the flap portion is relatively flat when it is folded onto the body portion to seal the entry opening.

According to the claimed invention, the transport pouch 1 is a foldable transport pouch, provided with an entry opening 21 in the front panel 5, with a form closure 27 and with a folding portion 4. The form closure 27 is provided in the flap portion between the transport space and the entry opening. The folding section is provided between the transport space and the form closure. Thus, with a transport pouch according to the claimed invention, to seal the entry opening the flap section with the form closure is folded on top of the body section. It has been found that in this configuration the fold section prevents the billowing, i.e. the front sheet moving away from the rear sheet, to substantially extend beyond the folding portion.

The fold keeps the front panel close to the rear panel, preventing the billowing to pass beyond the folding portion. Furthermore, because the flap portion of the transport pouch is folded onto the body portion of the transport pouch, the billowing of the body portion pushes the front panel with the first part of the form closure towards the rear panel with the second part of the form closure, and thus makes it harder for the form closure to be torn open. Thus, the transport configuration reduces the pressure on the form closure, and ultimo the pressure on the entry opening. Therefore, the transport pouch according to the claimed invention is able to withstand a significant relative pressure increase in the transport space without the sealing being broken.

The invention thus provides an alternative transport pouch, more in particular the invention allows for an improved transport pouch that is able to withstand a large drop in surrounding pressure without the billowing of the pouch causing the closure of the pouch to be torn open.

Furthermore, the transport pouch according to the claimed invention allows to provide a disposable transport pouch that is easy to use and/or can be obtained at low cost.

In the embodiment shown, in a direction perpendicular to the folding portion 4, the flap portion 2 has a size that is smaller than the size of the body portion 3, such that when the flap portion 2 is folded onto the body portion 3, as is shown in FIGS. 3-5, the flap portion 2 only partially overlaps the bottom portion 3. This allows for holding the body portion, at the part that will not be covered by the flap portion, while folding the flap portion onto the boy portion, and thus facilitates correctly and secure adhering the flap portion to the body portion of the transport pouch.

In the embodiment, the flap area 23 of the adhesive closure 22 extends from the left side of the transport pouch 1 to the right side of the transport pouch. Thus, the flap portion 2 and the body portion 3 are adhered to each other over the full width of the transport pouch 1, and thus along the entire fold 30 when the flap portion 2 is attached to the body portion 3. This ensures that the fold is optimally kept in position during a billowing of the body portion 3 of the transport pouch 1.

In the embodiment shown, when the flap portion 2 is adhered to the body portion 3, i.e. when the transport pouch is in the closed configuration, the adhesive covers at least 60% of the flap portion 3 and extends over substantially the entire width of the flap portion 3. Thus, the flap portion 3 is adhered over a large area to the body portion 2, which keeps the flap portion closely adjacent the body portion 3 prior to and during a billowing of the body portion. This further prevents a billowing of the body portion 3 from pulling away part of the flap portion 2 from the body portion and is thus beneficial for keeping the fold in position and thus for an optimal barrier effect of the fold 30.

Furthermore, in the embodiment shown, the front panel 5 and rear panel 6 are along their left side 9, right side 10, top side 7 and bottom side 8 sealed to each other along sealing zones 31. Thus, the sealing zone extend along the entire periphery of the transport pouch 1.

The sealing zone is a strip like area that is sealed to the opposite panel. The sealing zone 31 thus forms a strip, i.e. a relatively large sealing area, and thus for a strong bond between the front panel and the rear panel. A strong bond between the front panel and the rear panel allows for a high over pressure, i.e. a high pressure in the transport space compared to the pressure in the surroundings of the transport bag, in the transport space without the front panel tearing away from the rear panel.

In a further embodiment, below the body area of the adhesive closure, i.e. part of the strip along the side of the panels and extending between the bottom of the panel and the flap portion of the panel when the closed transport pouch is seen in frontal view, see FIGS. 3 and 4, at least at one side of the transport pouch is provided a recess, e.g. a V-shaped cut out. The recess is provided to initiate a tear, more in particular to enable a person to open the transport pouch by tearing open the body portion of the transport pouch.

In the embodiment shown, to open the pouch 1 after transport the flap portion 2 is pulled from the body portion 3. The flap portion is, at the side opposite the folding section, provided with a pull tab, i.e. an area with no adhesive and thus not adhered to the body portion, for engaging the flap by hand and for tearing the flap portion from the body portion to provide access to the entry port after transport.

It is noted that due to the folding portion forming a barrier during transport, a relative pressure increase in the transport space will not act fully, or even not at all, on the adhesive closure. Because the adhesive closure does not need to be able to withstand the full load of the relative pressure increase, the adhesive strength can be reduced. Thus the invention allows for a transport pouch comprising an adhesive closure for sealing the entry opening, that after transport can be opened by pulling the flap portion form the body portion.

In the embodiment shown, only the flap area 23 of the adhesive closure 22 is provided with an adhesive, while the body area 24 of the adhesive closure 22 is free from any adhesive. Thus, the at least one removable cover 25 is provided to the flap area. In an alternative embodiment, both the flap area of the adhesive closure and the body area of the adhesive closure are provided with adhesive, and with a removable cover.

Preferably, the flap area of the adhesive closure and the body area of the adhesive closure are arranged closely next to each other, for example are separated by a folding section such that the distance between the flap area and the body area is less than 2 cm, for example is 1 cm. Positioning the flap area close to the body area propagates a sharp fold, i.e. a fold with a small radius, in the transport pouch when the flap area is adhered to the body area, which is beneficial to the barrier properties of the fold.

In an embodiment, the form closure is located at a distance from the folding portion of the transport pouch, preferably is located at a distance from the folding section of the rear panel, such that when the flap section is folded onto the body section and the flap area is adhered to the body area, the form closure is located at least 1 cm, preferably is located at least 1.5 cm, away from an apex of the folded rear panel, i.e. the part of the folding section of the rear panel that extends substantially perpendicular to the flap section and the body section of the rear panel.

Providing distance between the form closure 27 and the folding portion 4 of the transport pouch 1, preferably the folding section 17 of the rear panel 6, allows for the form closure 27 to be located in a part of the flap portion 2 that is adjacent the body portion 3 of the transport pouch 1 when the adhesive closure 22 is closed and the flap portion 2 is folded onto and adhered to the body portion 3, as shown in FIG. 5. This in ensures that, in case of billowing of the body portion 3, the boy section 14 of the front panel 5 pushes against the flap section 12 of the front panel 5, and thus urges the first part 28 of the form closure 27, which is mounted on the inside surface of the front panel 5, towards the second part 29 of the form closure 27 mounted on the inside surface of the rear panel 6, and thus obstructs tearing open of the form closure by the billowing.

In an embodiment, the form closure is located at a distance from the folding portion, preferably is located at a distance from the folding section of the rear panel, such that when the flap section is folded onto the body section and the flap area is adhered to the body area, the form closure is located at most 3 cm, preferably is located at least 2 cm, away from an apex of the folded rear panel, i.e. the part of the folding section of the rear panel that extends substantially perpendicular to the flap section and the body section of the rear panel.

In the embodiment shown, the front panel 5 and the rear panel 6 are each rectangular panels, and the entry opening 21 is a slit in the front panel, which slit extends parallel to the top side 7 and the bottom side 8 of the front panel 5. Such a configuration is in particular beneficial when the transport pouch is to be opened after transport by tearing open the adhesive closure, because it allows for an optimal sealing of the entry opening, but also allows for easy pealing open starting at a corner of the rectangular sealing area.

For transporting the item 20 with the transport pouch 1, the item 20 is, via the entry opening 21 and the entry space 19, inserted into the transport space 18 of the transport pouch 1. Subsequently, the form closure 27 is closed, after which the at least one removable cover 26 is removed and the transport pouch 1 is folded along the folding portion 4 such that the flap area 23 of the adhesive closure 22 is adhered to the body area 24 of the adhesive closure 22 to seal the entry opening 21.

After the transport pouch 1 has thus been closed, the transport pouch can be transported, for example by air-mail. Once at the destination, the transport pouch 1 is opened, with the embodiment shown is opened by tearing flap portion 2 from the body portion 3, and thus enabling removal of the item 20 from the transport space 18 via the entry space 19 and the opening 21.

REFERENCE SIGNS

01 transport pouch
02 flap portion
03 body portion
04 folding portion
05 front panel
06 rear panel
07 top side panels
08 bottom side panels
09 left side panels
10 right side panels
11 interior space
12 flap section of the front panel
13 flap section of the rear panel
14 body section of the front panel
15 body section of the rear panel
16 folding section of the front panel
17 folding section of the rear panel

18 transport space
19 entry space
20 item
21 entry opening
22 adhesive closure
23 flap area adhesive closure
24 body area of the adhesive closure
25 removable cover
26 opening in removable cover
27 form closure
28 first part form closure
29 second part form closure
30 fold
31 sealing zone

The invention claimed is:

1. A transport pouch, having a flap portion and a body portion separated from each other by a folding portion, the transport pouch comprising:

a plastic front panel and a plastic rear panel, wherein the front panel and rear panel are connected to each other along a top side, a bottom side, a left side and a right side, and wherein the front panel and rear panel define between them an interior space, wherein the flap portion of the transport pouch comprises a flap section of the front panel and a flap section of the rear panel, and the body portion of the transport pouch comprises a body section of the front panel and a body section of the rear panel, wherein the flap section of the front panel and the flap section of the rear panel are separated from the respective body section of the front panel and body section of the rear panel by a folding section, along which folding section the flap portion of the transport pouch is foldable onto the body portion of the transport pouch, wherein the folding portion of the transport pouch divides the interior space into a transport space for holding an item, which transport space is provided in the body portion of the transport pouch, and an entry space, located in the flap portion of the transport pouch, and wherein the flap section of the front panel is provided with an entry opening for inserting the item, via the entry space, into the transport space of the transport pouch;

an adhesive closure, wherein the adhesive closure comprises a flap area on the flap section of the front panel and a body area on the body section of the front panel, wherein the entry opening is located in the flap area of the adhesive closure, and wherein at least one of the flap area and the body area of the adhesive closure is provided with an adhesive to enable the flap area to be adhered to the body area such that the entry opening is sealed along its entire periphery, to seal the transport pouch during transport;

at least one removable cover, wherein the at least one removable cover is provided on at least one of the flap area and the body area of the adhesive closure, to shield the adhesive prior to the flap area being adhered onto the body area, and wherein the at least one removable cover, when provided on the flap area of the adhesive closure, is provided with an opening that enables access to the entry opening in the flap section of the front panel; and a form closure, wherein the form closure is provided in the flap portion of the transport pouch, wherein the form closure comprises a first part and a second part, wherein the first part is disposed on an inside surface of the flap section of the front panel, between the entry opening and the folding section of the front panel, and extends between the left side and the right side of the front panel, wherein the second part is disposed on an inside surface of the flap section of the rear panel and extends between the left side and the right side of the rear panel, and which first part and second part of the form closure are configured to releasable mate such that the form closure, when closed, blocks passage from at least a part of the entry space to the transport space, such that, when the flap portion of the transport pouch is folded onto the body portion of the transport pouch, the flap area of the adhesive closure is adhered to the body area of the adhesive closure, and the form closure is closed, the folding portion of the transport pouch acts as a barrier that prevents billowing of the body portion of the transport pouch, caused by a relative pressure increase in the transport space due to a pressure drop in the surroundings of the transport pouch, from releasing the first part of the form closure from the second part of the form closure and thus from tearing open the form closure.

2. The transport pouch according to claim 1, wherein, in a direction perpendicular to the folding portion, the flap portion is smaller in size than the body portion, such that when the flap portion is folded onto the body portion, the flap portion only partially overlaps the body portion.

3. The transport pouch according to claim 1, wherein the front panel and rear panel are at least along at least one of their left side and their right side sealed to each other along sealing zones, the sealing zones each forming a strip that extends along at least one of the left side and the right side of the transport pouch.

4. The transport pouch according to claim 1, wherein the flap area of the adhesive closure and the body area of the adhesive closure are arranged closely next to each other, and are separated by a folding section such that the distance between the flap area and the body area is less than 2 cm.

5. The transport pouch according to claim 1, wherein the form closure is located at a distance from the folding portion, such that when the flap section is folded onto the body section and the flap area is adhered to the body area, the form closure is located at least 1 cm away from an apex of the folded rear panel.

6. The transport pouch according to claim 1, wherein the form closure is located at a distance from the folding portion, such that when the flap section is folded onto the body section and the flap area is adhered to the body area, the form closure is located at most 3 cm away from an apex of the folded rear panel.

7. The transport pouch according to claim 1, wherein the flap area or the body area of the adhesive closure is provided with an adhesive, and respectively the body section or the flap section of the front panel is provided with markings that indicate where the flap section of the transport pouch should be folded onto the body section of the transport pouch such that the flap area and the body area of the adhesive closure to seal the entry opening along the entire circumference.

8. The transport pouch according to claim 1, wherein the front panel and the rear panel are made from a flexible plastic sheet material, and wherein the plastic sheet material comprises multiple layers of different types of plastic materials.

9. The transport pouch according to claim 8, wherein the plastic sheet material has a thickness in the range of 3-7 micron.

10. The transport pouch according to claim 1, wherein the front panel and rear panel are each rectangular panels, and the entry opening is a slit in the front panel, which slit extends parallel to the top side and the bottom side of the front panel.

11. A method for transporting an item with the transport pouch according to claim 1, the method comprising:

via the entry opening and the entry space inserting an item into the transport space of the transport pouch;

closing the form closure;

removing the at least one removable cover; and folding the transport pouch along the folding portion such that the flap area of the adhesive closure is adhered to the body area of the adhesive closure to seal the entry opening.

12. The method according to claim 11, further comprising:

transporting the transport pouch with the item; and opening the transport pouch.

13. A method for manufacturing the transport pouch according to claim 1, the method comprising:

applying adhesive to at least one of the flap area and the body area of the adhesive closure on the front panel;

providing an entry opening in the flap area of the front panel;

between rear panel and front panel providing a form closure and fixing the form closure to the flap area of the front panel and the flap area of rear panel; and fixing the front panel to the rear panel such that the front panel and the rear panel are connected to each other along the top side, the bottom side, the left side and the right side, and the front panel and rear panel define between them an interior space.

* * * * *